United States Patent [19]

Di Maio et al.

[11] 4,045,994

[45] Sept. 6, 1977

[54] COMPRESSED AIR RIVET SETTING TOOL

[75] Inventors: Anthony E. Di Maio; Willem Swier, both of Georgetown, Mass.

[73] Assignee: Marson Fastener Corporation, Chelsea, Mass.

[21] Appl. No.: 702,876

[22] Filed: July 6, 1976

Related U.S. Application Data

[62] Division of Ser. No. 551,592, Feb. 21, 1975, Pat. No. 3,981,177.

[51] Int. Cl.[2] ..... B21J 15/34

[52] U.S. Cl. ..... 72/391; 91/461

[58] Field of Search ..... 72/391, 453.16, 453.17; 91/461; 173/169

[56] References Cited

U.S. PATENT DOCUMENTS

| | | | |
|---|---|---|---|
| 2,053,717 | 9/1936 | Huck | 72/450 |
| 2,053,720 | 9/1936 | Huck | 72/430 |
| 3,084,672 | 4/1963 | Dalton | 91/461 |
| 3,212,316 | 10/1965 | Smith | 72/453.16 |
| 3,323,346 | 6/1967 | Spangler | 72/453.16 |
| 3,374,656 | 3/1968 | Di Maio | 72/391 |
| 3,528,277 | 9/1970 | Perkins | 72/453.17 |
| 3,630,427 | 12/1971 | Stokes | 72/391 |
| 3,760,627 | 9/1973 | Richardson | 72/391 |
| 3,802,519 | 4/1974 | Newton | 173/169 |
| 3,929,056 | 12/1975 | Lange | 91/461 |

*Primary Examiner*—C.W. Lanham
*Assistant Examiner*—Gene P. Crosby

[57] ABSTRACT

An air-powered blind rivet setting tool including a pivotable transmission linkage between the compressed air powered piston rod unit and the rivet pulling mechanism including a valving arrangement for accomplishing cyclical operation of the tool.

4 Claims, 10 Drawing Figures

COMPRESSED AIR RIVET SETTING TOOL

This application is a divisional application of Ser. No. 551,592 filed Feb. 21, 1975, now U.S. Pat. No. 3,981,177.

BACKGROUND OF THE INVENTION

Rivets of the type which include a rivet body and a mandrel are referred to as pull or blind rivets. In the setting operation of these rivets they are inserted into the components to be joined, the mandrel is gripped, pulled axially, and its head upsets the rivet body forming a blind head. These rivets are well-known in the art and are further described, for example, in commonly-assigned DiMaio U.S. Pat. No. 3,374,656.

Blind rivets may be set, pulled or rivetted by tools powered by compressed air, hydraulic means, mechanical arrangement or combinations thereof.

Tools powered by compressed air piston which are mechanically connected to the mandrel pulling mechanism have been suggested in the art. For example, it has been suggested to pneumatically power a piston which is connected to a pivoted linkage which in turn is connected to the mandrel pulling mechanism. The pivoted linkage accomplishes a mechanical advantage in that the pulling mechanism moves through a lesser distance than the piston. Such prior mechanisms have, however, lacked success in that the mechanical advantage of the linkage is reduced as the power stroke nears its completion.

Other tools, have used springs to accomplish the return stroke thus requiring that the spring force be overcome during the power stroke and reducing the effective pulling force of the tool.

The present invention provides a mechanical linkage which maintains an undiminished mechanical advantage between the rivet pulling assembly and the piston and rod unit throughout the power stroke. In addition, the present invention provides a new and useful way of controlling the air pressure to effect the operation of the tool during both power and return strokes.

SUMMARY OF THE INVENTION

Broadly, the present invention comprises a rivet setting tool including a rivet pulling mechanism, an air powered piston rod disposed at a substantial angle to the rivet pulling mechanism and pivotable lever means connecting the piston rod and pulling mechanism to accomplish and maintain undiminished a high mechanical advantage between the piston rod and the pulling mechanism throughout the power stroke. The lever means includes a curved surface which slidably rides on a flat surface of the rod which surface is perpendicular to the longitudinal axis of the piston rod. The tool also includes a valve arrangement for moving by air the piston and rod unit both on the power and return strokes.

It is a feature that the high mechanical advantage is maintained throughout the power stroke.

It is also a feature that the recoil of the tool is minimal.

A DESCRIPTION OF THE PREFERRED EMBODIMENTS

Figure 1:
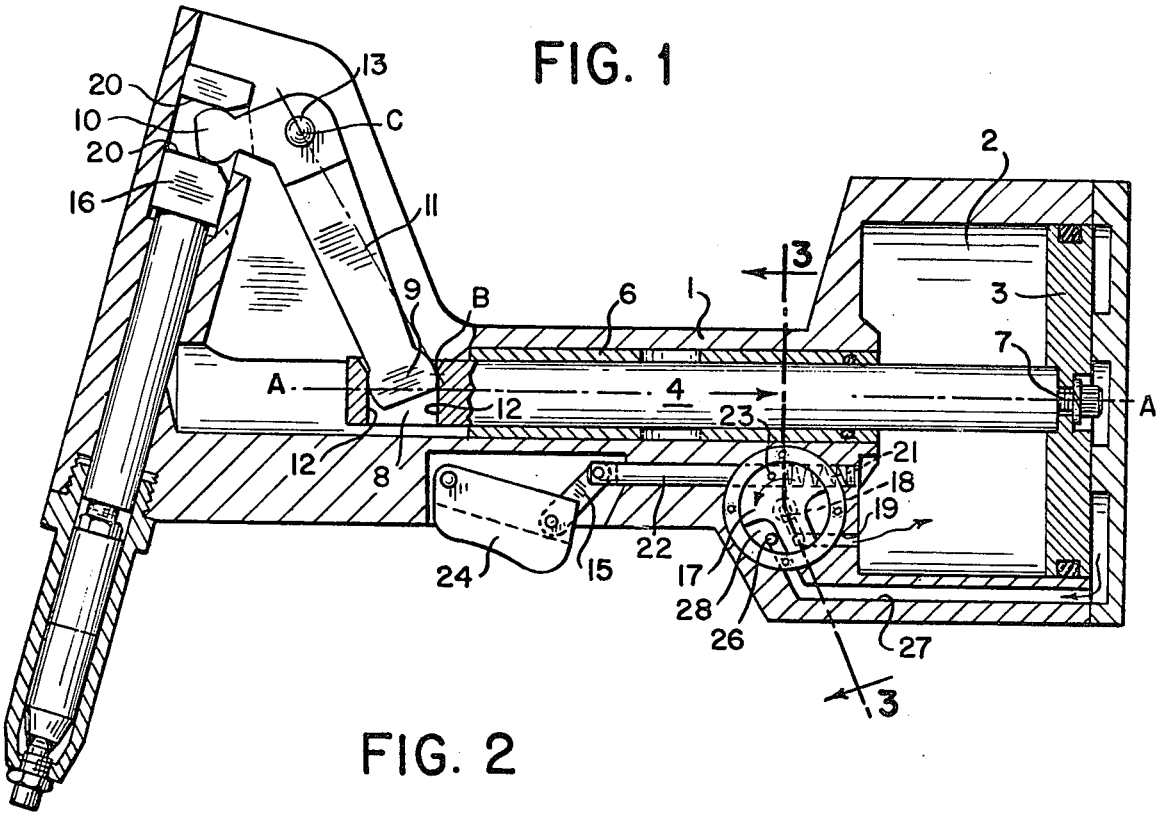
FIG. 1 is a sectional elevational view of the tool in the rest position.

Referring to the Figures, tool housing 1 has within it air power cylinder 2, piston 3 and piston rod 4 which piston and rod unit reciprocate back and forth along axis line A. Piston rod 4 is closely fitted in sleeve bearing 6 to maintain the reciprocation of the unit back and forth along center line A.

Figure 4:
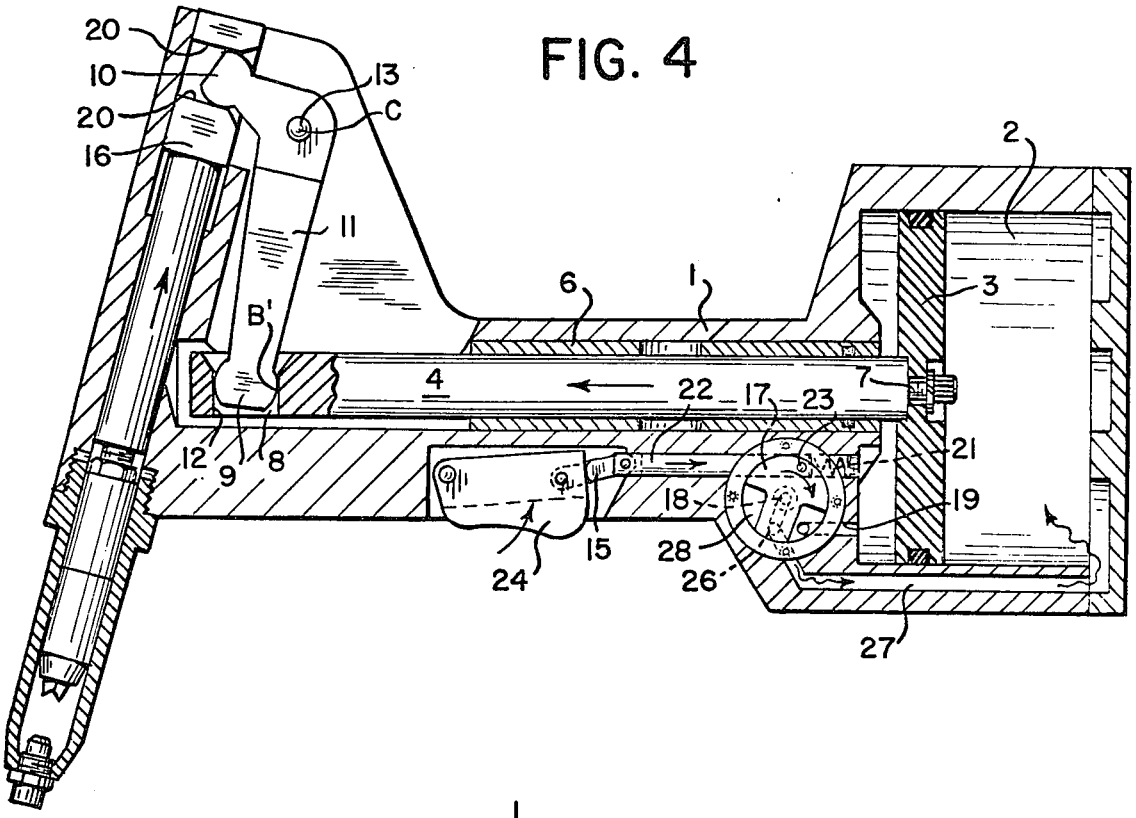
FIG. 4 is a sectional elevational view of the tool at the completion of the power stroke.
Figure 5:
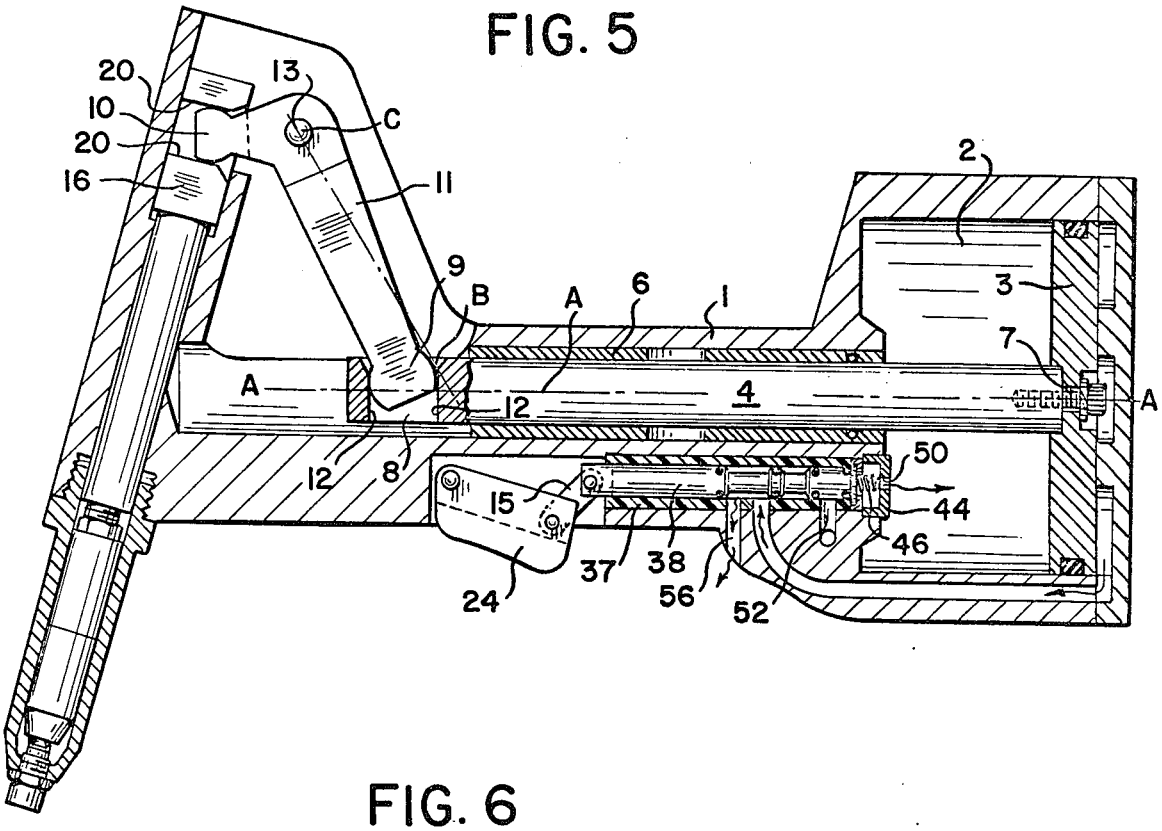
FIG. 5 is a sectional elevational view of another embodiment of the tool in rest position which has a slidable valve control mechanism.

Piston rod 4 is secured at one end through threaded screw 7 to piston 3 and near the other end there is a recessed portion 8 for receiving, in sliding engagement, the curved end portion 9 of pivotable lever arm 11 (FIG. 5). When piston rod 4 is in the rest position, as shown in FIG. 1, lever end portion 9 and a vertical engaging surface 12 of the recess 8 engage in a camming manner along a line viewed in FIG. 1 at point B which point is above centerline A. When piston rod 4 has completed its power stroke, as shown in FIG. 4, the contact line between the end portion 9 and cam surface 12 is indicated at B′. Arm 11 rotates about pivot point C, the center of axle 13, and the contacting arrangement provides that the distance between C and B and the distance between C and B′ are equal.

The other end of lever 11 includes bifurcated ears 10 which engage side recess areas 20 of rivet pulling assembly rod 16 in a camping manner so that the mechanical advantage between the piston rod 4 and the rivet pulling assembly rod 16 also remains constant throughout the power stroke. The mechanical advantage is about 3 to 1 which is a high mechanical advantage for tools of this type. During the return stroke, lever arm 11, including end portion 9, engages opposing surface 12 of recess 8 during the movement of piston 3 and rod 4 to the right under the force of the air pressure used to accomplish the return stroke as herein further described.

When the rivet mandrel snaps upon setting of the rivet, the rivet pulling rod 16 will move more rapidly in the direction away from the rivet while the piston and rod unit will move more rapidly away from the piston cylinder 2. Since the directions of these two movements are at substantial angles one to the other, the hand held tool has a minimum of recoil and is easy to use.

Figure 2:
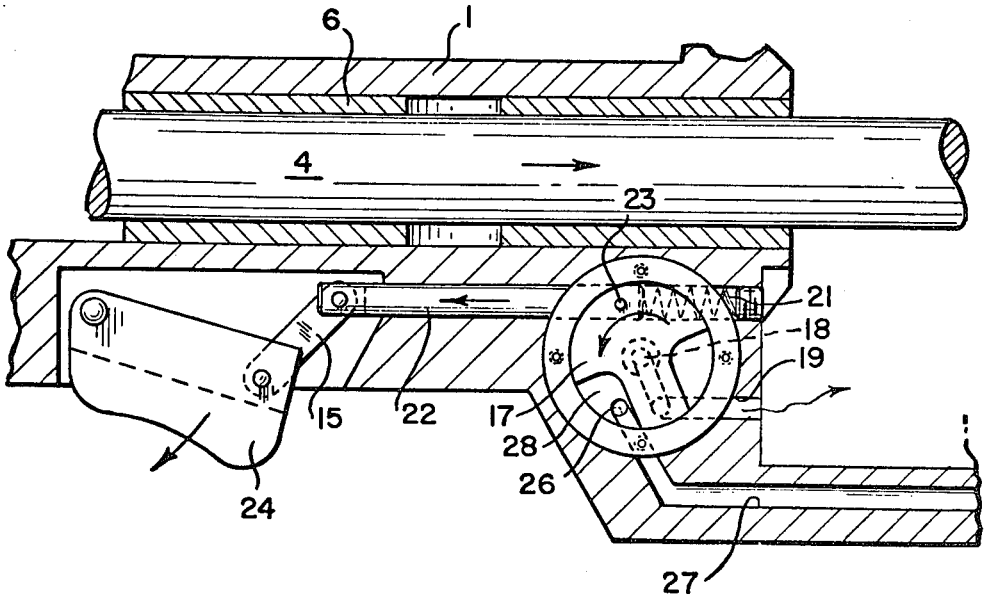
FIG. 2 is an expanded sectional elevational view of the valve control mechanism in the rest position.
Figure 3:
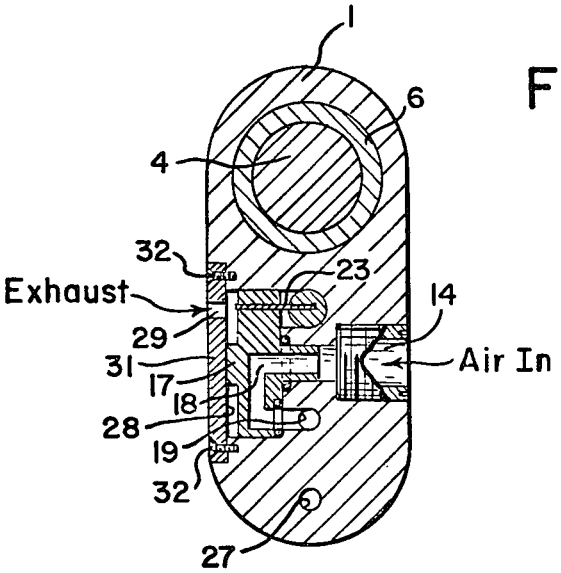
FIG. 3 is a sectional view taken along line 3—3 of FIG. 1.

Turning to the air pressure system and the valve arrangement of the preferred embodiment, rotary valve 17 is shown in its rest position in FIGS. 1, 2 and 3 in which line air pressure entering inlet 14 (FIG. 3) passes through passage 18 in rotary valve 17, along horizontal passageway 19 in the housing and into cylinder 2 where the pressure holds piston 3 in a righthand position. Spring 21 urges trigger rod 22 to the left to hold the position shown in FIGS. 1, 2 and 3.

When trigger rod 22, which is connected to valve 17 through pin 23, is moved to the right by operation of the trigger 24 valve 17 turns clockwise moving passage 18 to communication with passageway end 26 of passageway 27 thus placing line pressure on the right hand side of piston 3 to start and complete the power stroke. During the power stroke air on the left-hand side of piston 3 exhausts to atmosphere through passage 19, exhaust chamber 28 and exit 29.

As the trigger is released after the power stroke, trigger rod 22 returns under spring pressure to the left thus rotating the valve back to the position shown in FIG. 1 thereby placing the passageway end 26 of passageway 27 in communication with exhaust chamber 28 which has exit 29 permitting air on the right hand side of piston 3 to exhaust to atmosphere. As inserted circular cap 31 is attached to housing with screws 32. Exhaust hole 29 is in the circular cap 31 which cap is not shown in FIGS. 1 and 2 to permit a view of valve 17.

Figure 6:
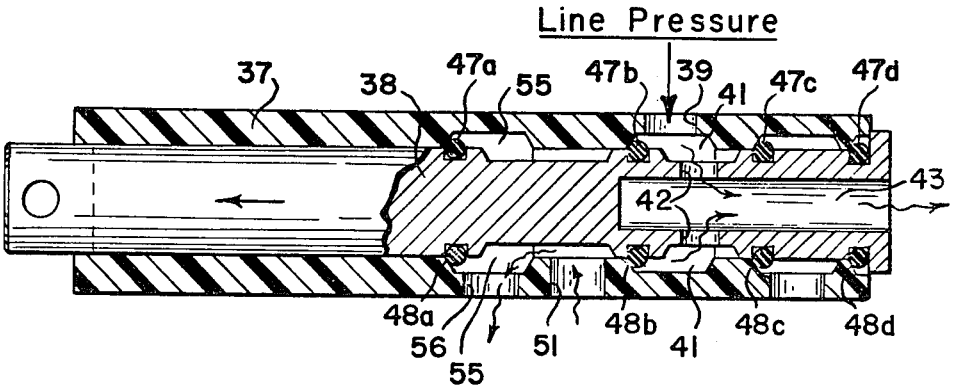
FIG. 6 is an enlarged sectional view of the mechanism in the rest position.
Figure 9:
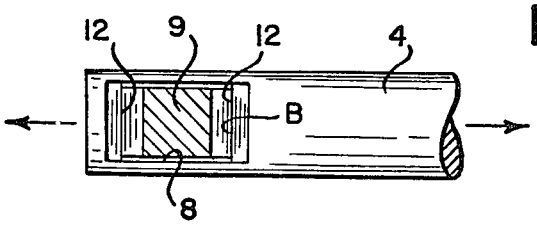
FIG. 9 is a partial sectional view showing the engagement of the lever arm and the piston rod.
Figure 7:
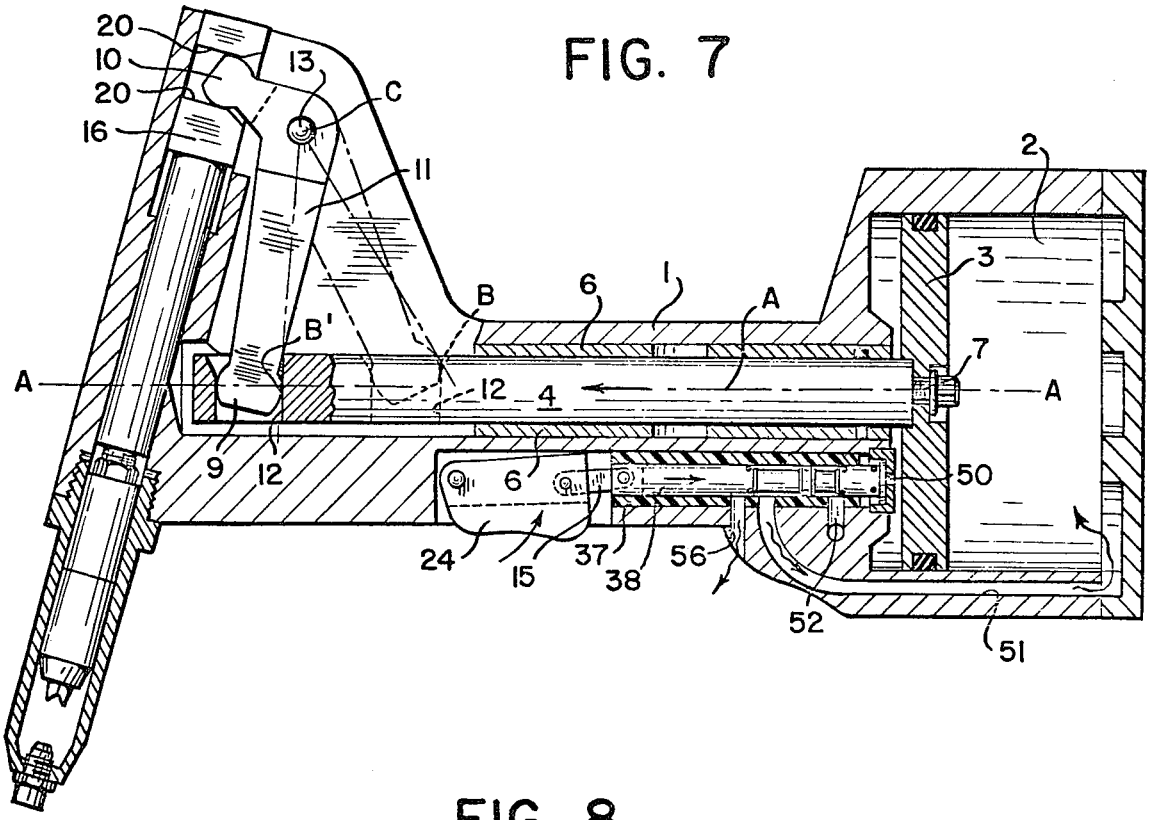
FIG. 7 is a sectional elevational view of the second embodiment at the completion of the power stroke.

Turning now to the alternative valve arrangement embodiment (FIGS. 5–8), cylindrical sleeve 37 houses reciprocating valve member 38 which is dimensioned to provide a substantially air tight fit with sleeve 37. When piston 3 is in the rest position (FIGS. 5 and 6), pivotable trigger 24 is rotated clockwise and trigger connector 15 is at about a 45% angle to centerline A due to the force of spring 46 urging the valve member 38 to the left. In this position, valve member 38 permits line air pressure to pass through inlet hole 39, chamber 41, valve member holes 42 and along longitudinal valve member passage 43 through opening 50 into air cylinder 2. The air pressure moves piston 3 to the position shown in FIG. 5 and holds it there. Spring 46, which is partially housed in passage 43 to maintain the spring in proper axial alignment, maintains the valve member 38 in this position until the tool is ready for operation.

Figure 8:
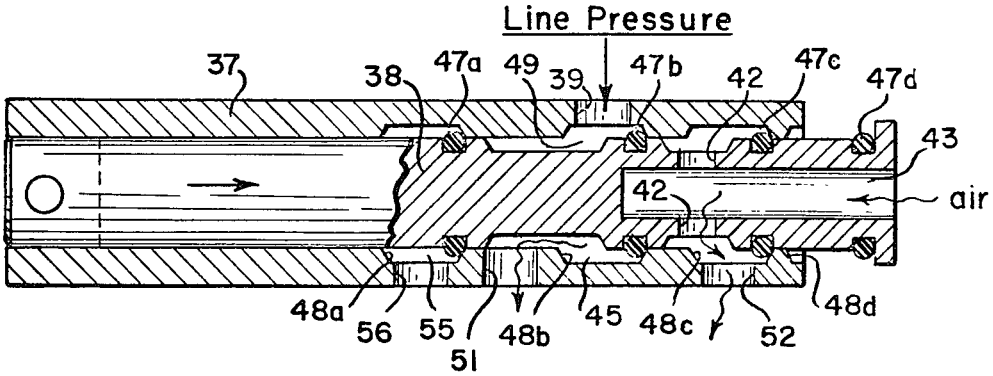
FIG. 8 is an enlarged elevational view of the slide valve control mechanism at the completion of the power stroke.
Figure 10:
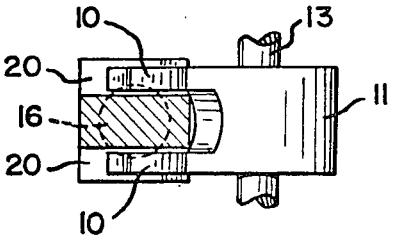
FIG. 10 is a partial sectional view showing the engagement of the lever arm and the pulling mechanism.

When trigger 24 is squeezed and moved upward, trigger connector 15 causes valve member 38 to travel to the right against spring 46 moving sealing rings **47*a–b* off sleeve ring seats 48*a–b*. As the valve member 38 moves further to the right line air pressure is able to pass through chamber 49 (FIG. 8) and through power air passage 51 thus permitting the portion of air cylinder 2 which is on the right hand side of piston 3 and starting the power stroke. As piston 3 moves to the left during the power stroke, air pushed by it exhausts through passage 43, holes 42 and exhaust port 52 (FIG. 8). During the power stroke line pressure is prevented from entering passage 43 and the portion of cylinder 2 on the left hand side of piston 3 by seal 47*b* seated against ring seat 48*b***.

Upon completion of the power stroke and release of trigger 14, the spring 46 will move valve member 38 back to the left which will cause the line pressure to be exerted against the left hand side of piston 3 as described above. As piston 3 moves to the right it pushes air out line 51 into chamber 55 and out exhaust port 56. The tool is now ready for another cycle.

We claim:

1. A compressed air-powered blind rivet setting tool comprising a. a housing;

b. a piston within the housing for movement by compressed air;

c. a piston rod connected to the piston and supported for reciprocating movement along a straight line within the housing;

d. rivet pulling means reciprocally mounted in said housing and spaced from the piston rod;

e. a pivotable lever member pivoted about a pivot axle on the housing, said lever member having a first cam surface at one end portion which surface is slidably engageable on the pulling means and having a second cam surface at the other end portion slidably engageable with the piston rod so that as the piston rod is moved a distance by the compressed air the rivet pulling means is moved a fraction of that distance, said lever member cam surfaces being shaped so that as the member pivots about the axle the distances between the axle and the lines of contact between the cam surfaces on the one hand and the pulling means and piston rod on the other hand remain constant; and f. compressed air control means including valve means which direct compressed air to cause movement of the piston in one direction for actuating the rivet pulling means and cause movement of the piston in the other direction to return the piston, said compressed air control means includes a sleeve having an internal wall, a valve member slidable a selected distance within the sleeve between two limits each limit being defined by the engagement of a seal ring carried by the valve member against seat surfaces of the sleeve in abutting air tight engagement, said seat surfaces being formed in recesses in the internal sleeve wall.

2. The tool of claim 1 in which said sleeve has first and second opening means formed through the wall thereof, said first opening means for permitting fluid to pass therethrough to the valve member and to one side of the piston whenever said valve member is in one of said two limit positions, said second opening means permitting fluid communication between the other side of the piston and the atmosphere whenever in the other of said two limit positions, and said valve member is formed with a central passage therethrough for fluidically communicating with said first opening means whenever in said other of said two limit positions.

3. The tool of claim 2 in which said second opening means comprises a pair of separate and spaced apart openings formed in the internal wall of said sleeve, each on opposite sides of one of said seat surfaces.

4. A compressed air-powered blind rivet setting tool comprising a. a housing;

b. a piston within the housing for movement by compressed air;

c. a piston rod connected to the piston and supported for reciprocating movement along a straight line within the housing;

d. rivet pulling means reciprocally mounted in said housing and spaced from the piston rod;

e. a pivotable lever member pivoted about a pivot axle on the housing, said lever member having a first cam surface at one end portion which surface is slidably engageable on the pulling means and having a second cam surface at the other end portion slidably engageable with the piston rod so that as the piston rod is moved a distance by the compressed air the rivet pulling means is moved a fraction of that distance, said lever member cam surfaces being shaped so that as the member pivots about the axle the distances between the axle and the lines of contact between the cam surfaces on the one hand and the pulling means and piston rod on the other hand remain constant; and f. compressed air control means including valve means which direct compressed air to cause movement of the piston in one direction for actuating the rivet pulling means and cause movement of the piston in the other direction to return the piston said compressed air control means includes a sleeve having an internal wall, a valve member slidable a selected distance within the sleeve between two limits each limit being defined by the engagement of a seal ring carried by the valve member against seat surfaces of the sleeve in abutting air tight engagement, said seat surfaces being formed in recesses in the internal sleeve wall, said sleeve has first and second opening means formed through the wall thereof, said first opening means for permitting fluid to pass therethrough to the valve member and to one side of the piston whenever said valve member is in one of said two limit positions, said second opening means permitting fluid communication between the other side of the piston and the atmosphere whenever in the other of said two limit positions, and said valve member is formed with a central passage therethrough for fluidically communicating with said first opening means whenever in said other of said two limit positions, said second opening means comprises a pair of separate and spaced apart openings formed in the internal wall of said sleeve, each on opposite sides of one of said seat surfaces, whereby one of said openings communicates with atmosphere and said other opening communicates with the other side of the piston.

* * * * *

UNITED STATES PATENT AND TRADEMARK OFFICE

CERTIFICATE OF CORRECTION

PATENT NO. : 4,045,994

DATED : Sept. 6, 1977

INVENTOR(S) : Anthony E. Di Maio and Willem Swier

It is certified that error appears in the above-identified patent and that said Letters Patent are hereby corrected as shown below:

Column 2, line 43, "camping" should read --camming--

Column 3, line 44, "permitting" should read --pressurizing--

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*